US011050202B1

(12) United States Patent
Wang et al.

(10) Patent No.: US 11,050,202 B1
(45) Date of Patent: Jun. 29, 2021

(54) FOLDABLE 2-PIN AC POWER PLUG/EXTENSION CORD

(71) Applicant: BBY SOLUTIONS, INC., Richfield, MN (US)

(72) Inventors: Jin Wang, ShenZhen (CN); Fan Tang, ShenZhen (CN)

(73) Assignee: BBY Solutions, Inc., Richfield, MN (US)

( * ) Notice: Subject to any disclaimer, the term of this patent is extended or adjusted under 35 U.S.C. 154(b) by 0 days.

(21) Appl. No.: 16/798,819

(22) Filed: Feb. 24, 2020

(51) Int. Cl.

| | |
|---|---|
| ***H01R 31/06*** | (2006.01) |
| ***H01R 24/20*** | (2011.01) |
| ***H01R 13/627*** | (2006.01) |
| ***H01R 13/50*** | (2006.01) |
| *H01R 103/00* | (2006.01) |

(52) U.S. Cl.
CPC ..... *H01R 31/06* (2013.01); *H01R 13/50* (2013.01); *H01R 13/6272* (2013.01); *H01R 24/20* (2013.01); *H01R 2103/00* (2013.01)

(58) Field of Classification Search
CPC .... H01R 31/06; H01R 24/20; H01R 13/5841; H01R 27/00; H01R 35/04; H01R 35/00; H01R 25/003; H01R 25/006; H01R 13/50; H01R 13/6272; H01R 2103/00
See application file for complete search history.

(56) References Cited

U.S. PATENT DOCUMENTS

| | | | | |
|---|---|---|---|---|
| 7,125,273 | B2 | 10/2006 | Irwin | |
| 7,442,090 | B2 * | 10/2008 | Mori | H01R 25/003 174/53 |
| 8,641,459 | B1 | 2/2014 | Matsuoka | |
| 2002/0127898 | A1 | 9/2002 | Liu | |
| 2004/0002229 | A1 * | 1/2004 | Wang | H01R 24/30 439/31 |
| 2009/0117765 | A1 | 5/2009 | Wen | |

* cited by examiner

*Primary Examiner* — Vanessa Girardi
(74) *Attorney, Agent, or Firm* — James M. Urzedowski; Daniel A. Tysver

(57) ABSTRACT

An electrical extension cord with a unique jack for use with an AC adapter assembly is presented. The jack includes a housing that defines a planar surface upon which a channel structure is positioned. The channel structure defines first and second channels which are sized and shaped to receive one of the pins of a 2-pin foldable plug of the AC adapter when the plug is in the folded state and contained within a recess of the AC adapter body.

13 Claims, 4 Drawing Sheets

20
β
56
14
22
44
24
26
18
α
12
32
40
30
36
10
60
16a
16b

FOLDABLE 2-PIN AC POWER PLUG/EXTENSION CORD

FIELD OF THE INVENTION

Embodiments of the disclosure described herein are directed to the field of electrical power cords for transmitting electrical power from a wall outlet or other AC electrical power source, to a device such as an AC/DC power adapter that would normally plug directly into a wall outlet. More specifically, embodiments described herein, are directed to an extension cord having a uniquely configured jack or receiver port and an AC/DC adapter having a uniquely configured plug, which in combination, allow the plug of the adapter to plug into the extension cord jack even when the prongs (pins) of the plug are in a folded down position against the body of the DC adapter.

SUMMARY

Many consumer electronics utilize AC power interfaces (adapters, etc.) having foldable 2-pin plug assemblies. See for example, see the foldable pug connectors and devices of U.S. Pat. Nos. 6,312,271 and 7,510,409; the entire contents of each being incorporated herein by reference. In many commercially available devices that are equipped with such 2-pin foldable plugs, the plug is essentially a plug module that is removeable from the device or adapter, and which can be switched out with other "modules" such as a different type of plug or an extension cord. The cord and interface of the present disclosure is configured to be used with the foldable 2-pin plug in place, and in its folded configuration, thereby eliminating any need to switch-out the foldable 2-pin plug. Not only does this allow for a reduction in components, but when an adapter is connected to the cord of the present disclosure in the unique manner disclosed, the adapter may now be used at a distance from the electrical outlet while maintaining a more compact shape, and safer electrical interface.

DETAILED DESCRIPTION

In accordance with example embodiments of the disclosure, an extension cord, cord systems and apparatuses are provided, and which are illustrated in FIGS. 1-5.

Figure 1:
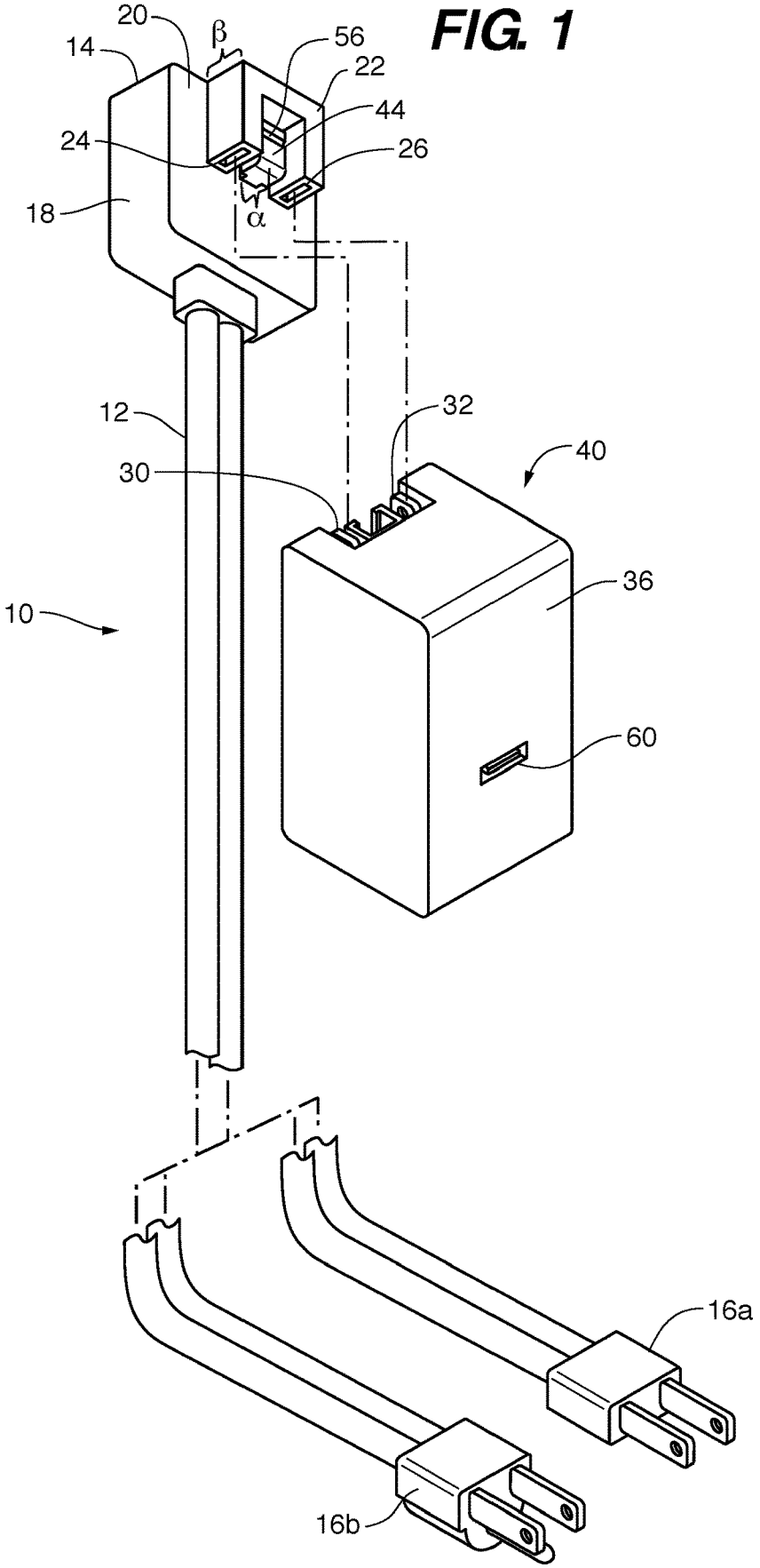
FIG. 1 is a front perspective view of an extension cord configured for use with an AC power adapter having a foldable 2-pin plug.

Turning to FIG. 1, one example extension cord 10 includes an elongated cord portion 12 that terminates at one end in a receiver portion or jack 14 and at the other end in a conventional 2-pin plug 16*a* or optional 3-pin plug 16*b*. In alternative embodiments (not shown) the plug may be configured as a European standard style 2-pin plug (aka: "Europlug"), or an Australian plug (AS/NZS 3112). The extension cord 10 includes all of the typical components of a conventional electrical extension cord, but with a uniquely configured jack 14. The jack 14 of the cord 10 includes a housing 18 which defines a first planar surface or face 20. The housing 18 includes a structure 22 projecting outward from the planar surface 20, and which defines a first channel 24 and a second channel 26. The channels 24 and 26 are parallel to each other and run parallel to the planar surface 18.

Each channel 24 and 26 are sized and shaped to receive one of the prongs or pins 30 and 32 of a 2-pin plug 34 and thereby form an electrically conductive connection between the cord 10 and plug 34. When the pins 30 and 32 are received into the respective channels 24 and 26, the pins 30 and 32 are positioned parallel to the planar surface 18.

Figure 2:
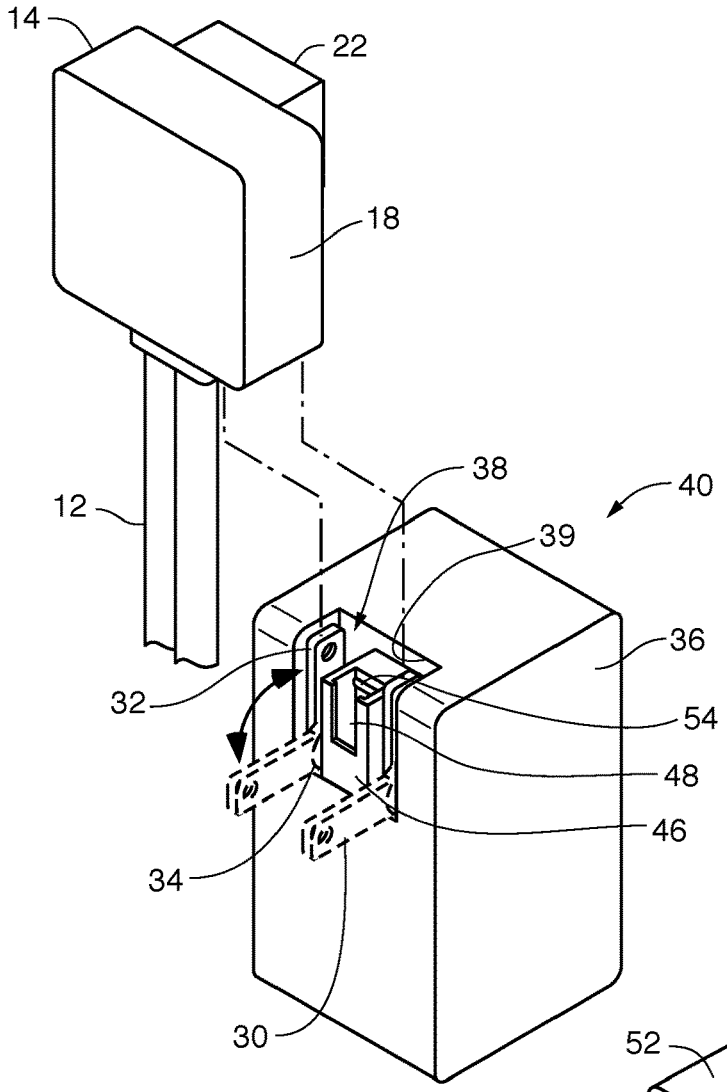
FIG. 2 is a closer, rear perspective view of the embodiment shown in FIG. 1 wherein engagement surfaces of the AC power adapter are visible.

As shown in FIG. 2, the plug 34 is a foldable plug that is pivotally engaged to the body 36 of an AC adapter 40. The pins 30 and 32 may be pivoted between a recessed or folded position, wherein they are held within a recess 38, and along a recessed surface 39, defined by the body 36 of the AC adapter 40; to an extended position (pins shown in dashed lines in FIG. 2) wherein a portion of each pin 30 and 32 extend perpendicularly outward from the recessed surface 39 of the body 36.

Given the size, shape and construction of the body of the AC adapter 36 relative to that of the jack housing 18, it is only when the plug 34 is in the folded position that the pins 30 and 32 are able to be received by the respective channels 24 and 26 in the manner shown in the figures.

Figure 3:
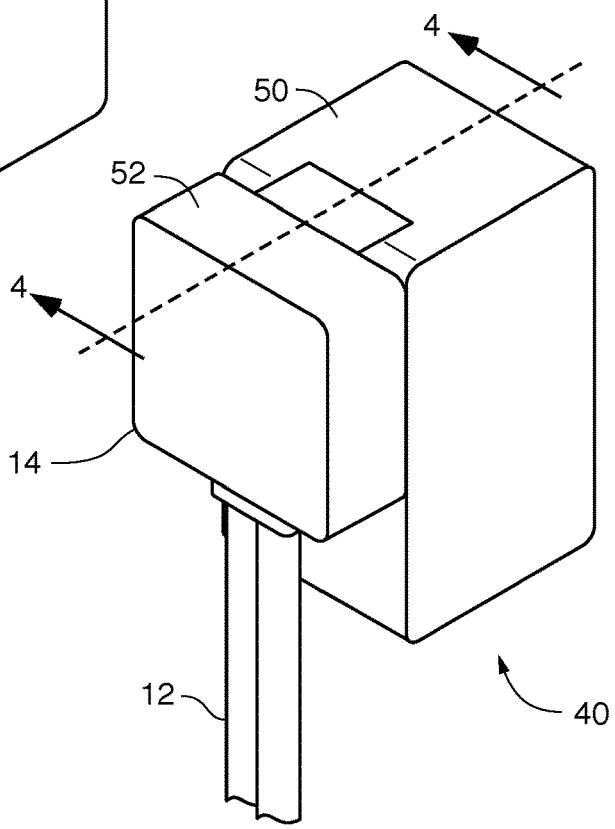
FIG. 3 shows the jack portion of the extension cord engaged to the AC power adapter of FIG. 2.
Figure 5:
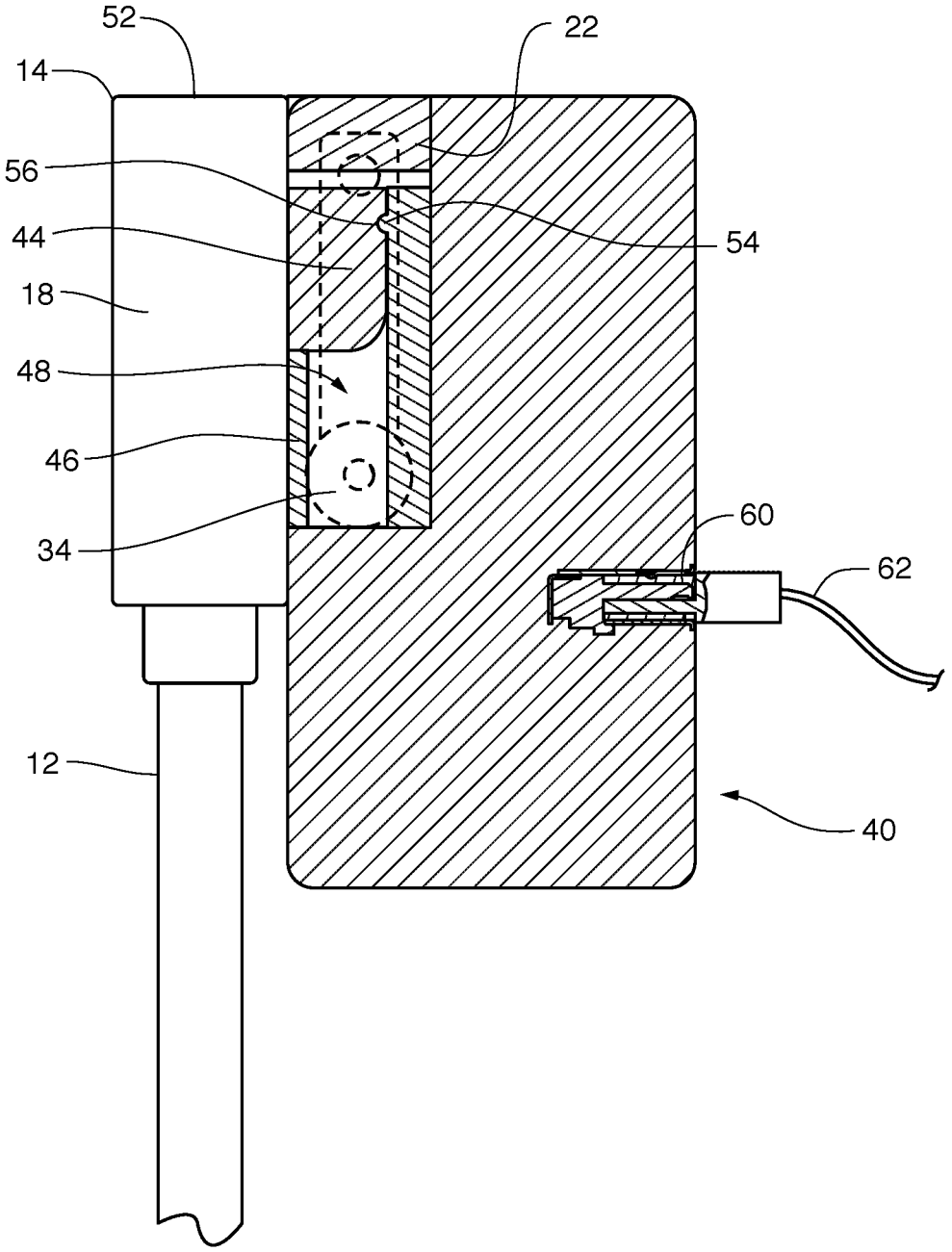
FIG. 5 is a sectional side view of the engaged jack portion of the extension cord shown in FIG. 3; a USB cable is also shown engaged to the AC adapter.

In at least one embodiment, the interface between the jack housing 18 and adapter body 36 is also provided with a mechanism to provide a snap fit engagement whereby the jack 14 is "locked" to the adapter 40 when the jack 14 is fully engaged to the adapter 40 in the manner shown FIGS. 3 and 5. To accomplish this, the jack 14 is provided with a knob or other protrusion 44 that extends outward from the planar surface 20. The knob 44 is adjacent to the channel structure 22 and has a height $\alpha$, as measured from the planar surface 22, which is less than the height $\beta$ of the channel structure 22. On the body 36 of the adapter 40, along the recessed surface 39 is positioned a knob housing 46 which defines a knob receipt channel 48.

In at least one embodiment, the knob receipt channel 48 is sized and shaped to receive the knob 44 therein. The knob receipt channel 48 is positioned within the recess 38 of the adapter body 36 in such a way as to ensure that when the pins 30 and 32 are fully engaged within the channels 24 and 26, a top housing surface 50 of the jack housing 18 and a top body surface 52 of the adapter body 36 are co-planar in the manner shown in FIGS. 3 and 5.

In at least one embodiment, the top housing surface 50 of the jack is perpendicular to the planar surface 20. In at least one embodiment, the top body surface 52 of the adapter body 36 is perpendicular to the recessed surface 39.

Figure 4:
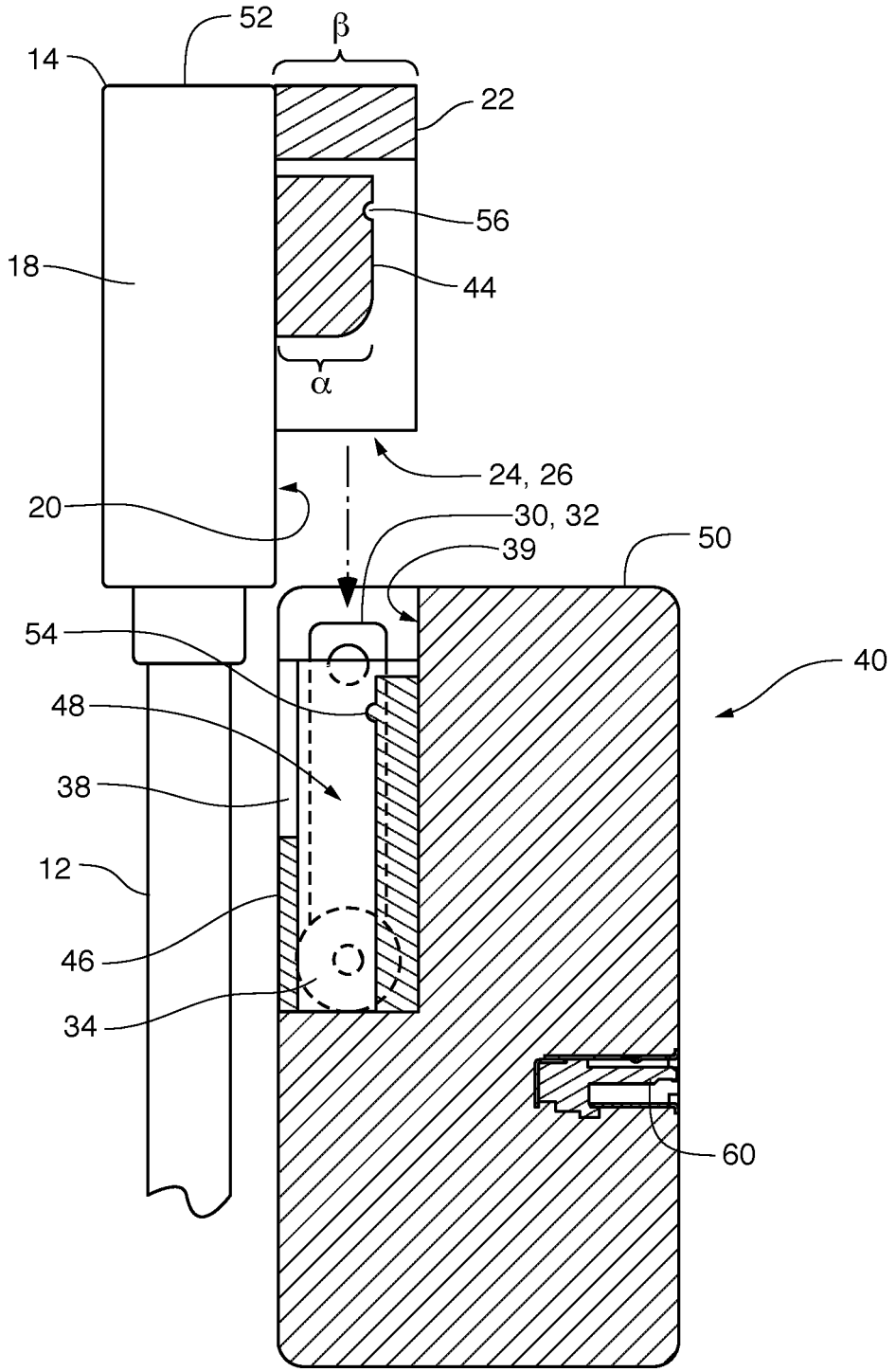
FIG. 4 is a sectional side view of the jack portion of the extension cord and AC adapter shown in FIG. 2.

Turning to FIGS. 2, 4 and 5, it is shown that within the knob receipt channel 48 of the knob housing 46, a lock bump or ridge 54 is present. The bump 54 protrudes from the otherwise uniform knob receipt channel 48 and is positioned to removeably engage a notch 56 defined by a surface of the knob 44 only when the pins 30 and 32 are fully received into the channels 24 and 26 in the manner shown in FIGS. 3 and 5. The notch 56 and bump 54 are of a complimentary size and shape, such that when engaged together they act to "lock" the jack 14 of the cord 10 to the plug 32 of adapter 40.

The terms "locked" and "lock" as used herein refer to the mechanical snap-fit engagement of the lock bump 54 with the notch 56 when the pins 30 and 32 of the plug 34 are fully received within the respective channels 24 and 26 of the jack 14 as is shown in FIG. 3.

In at least one embodiment, it requires a greater application of force to withdraw the pins 30 and 32 of the plug 34 from the respective channels 24 and 26 of the jack 14, and thereby disengage the lock bump 54 from the notch 56, than is required lock the components together.

This locking interface ensures that even when the adapter 40 and cord 10 are placed in the open, or in high traffic areas, their interface is maintained safely, securely and in as streamlined a manner as is possible.

In at least one embodiment, as shown in FIGS. 1, 4 and 5, the AC adapter 40 will include one or more ports 60 for receipt of a Universal Serial Bus (USB), or (the equivalent) cord 62 (shown in FIG. 5) of various configurations (e.g. Mini-USB, Micro-USB, USB A-C, Lightning Jack, etc.) from which the converted AC to DC current may be transmitted from the adapter 40 to a consumer electronic device (not shown). In some embodiments, where the AC adapter 40 is provided with multiple ports 60, the ports may be of the same or different configurations.

Many other features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. An electrical extension cord configured for use with a 2-pin foldable plug, the electrical extension cord comprising a jack, the jack having a housing, the housing defining a planar surface and a top surface, the housing including a channel structure projecting outward from the planar surface, the channel structure defining a first channel and a second channel, the first channel and second channel are parallel to one another and to the planar surface;

the electrical extension cord further comprising a knob, the knob being a protrusion that extends outward from the planar surface and is adjacent to the channel structure, the knob having a height and the channel structure having a height, the height of the knob being less than that of the channel structure.

2. The cord of claim 1, wherein the top surface is perpendicular to the planar surface.

3. The cord of claim 1, wherein the knob defines a notch.

4. An electrical extension cord and AC adapter assembly, the assembly comprising:

an extension cord, the extension cord having a jack, the jack having a housing, the housing defining a planar surface and a top housing surface, the housing including a channel structure projecting outward from the planar surface, the channel structure defining a first channel and a second channel, the first channel and second channel are parallel to one another and to the planar surface;

an AC adapter, the AC adapter having a body, the body having a foldable 2-pin plug pivotally engaged thereto, the 2-pin plug having a folded state and an extended state, in the folded state the 2-pin plug being positioned entirely within a recess defined by the body, in the extended state at least a portion of the 2-pin plug extending perpendicularly from the recess, only when in the folded state is the 2-pin plug able to engage the channel structure of the jack, the 2-pin plug comprising a first pin and a second pin, the first pin being of a size and shape corresponding to the size and shape of the first channel so as to accommodate engagement of the first pin into the first channel when the 2-pin plug is in the folded state, the second pin being of a size and shape corresponding to the size and shape of the second channel so as to accommodate engagement of the second pin into the second channel when the 2-pin plug is in the folded state.

5. The assembly of claim 4, further comprising a knob, the knob being a protrusion that extends outward from the planar surface and is adjacent to the channel structure.

6. The assembly of claim 5, wherein the knob has a height and the channel structure has a height, the height of the knob being less than that of the channel structure.

7. The assembly of claim 5, wherein the knob defines a notch.

8. The assembly of claim 7, wherein the AC adapter body further comprises a knob housing positioned within the recess, the knob housing defining a knob receipt channel, the knob receipt channel sized and shaped to receive the knob therein when the 2-pin plug is engaged to the channel structure of the jack.

9. The assembly of claim 8 wherein the knob and knob housing are configured to lock together in a snap-fit engagement.

10. The assembly of claim 4 wherein the top housing surface is perpendicular to the planar surface.

11. The assembly of claim 10 wherein the recess includes a recessed surface, in the folded state the first pin and the second pin of the 2-pin plug are positioned parallel to the recessed surface.

12. The assembly of claim 11 wherein the AC adapter body further defines a top body surface, the top body surface being perpendicular to the recessed surface.

13. The assembly of claim 12 wherein when the 2-pin plug is engaged to the channel structure of the jack, the top housing surface and the top body surface are coplanar.

* * * * *